US007662261B2

(12) United States Patent
Kurkinen et al.

(10) Patent No.: US 7,662,261 B2
(45) Date of Patent: Feb. 16, 2010

(54) BEAM STRUCTURE FOR A WEB FORMING MACHINE

(75) Inventors: Leo Kurkinen, Helsinki (FI); Rami Vanninen, Kellokoski (FI); Sami Lumijärvi, Kellokoski (FI); Kari Vasenius, Järvenpää (FI); Kari Holopainen, Muurame (FI); Reijo Hassinen, Leppävesi (FI); Hannu Nikula, Jyväskylä (FI); Jukka Samppala, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 445 days.

(21) Appl. No.: 11/572,250

(22) PCT Filed: Jun. 22, 2005

(86) PCT No.: PCT/FI2005/050232

§ 371 (c)(1),
(2), (4) Date: Jan. 17, 2007

(87) PCT Pub. No.: WO2006/010794

PCT Pub. Date: Feb. 2, 2006

(65) Prior Publication Data

US 2007/0163738 A1 Jul. 19, 2007

(30) Foreign Application Priority Data

Jul. 28, 2004 (FI) ..... 20045281

(51) Int. Cl.
*D21F 7/06* (2006.01)

(52) U.S. Cl. ..... 162/263; 162/281; 162/111; 15/256.11

(58) Field of Classification Search ..... 162/263, 162/281, 111; 15/256.51
See application file for complete search history.

(56) References Cited

U.S. PATENT DOCUMENTS

| | | | |
|---|---|---|---|
| 4,537,659 | A | 8/1985 | Koski |
| 5,005,515 | A | 4/1991 | Sollinger |
| 5,356,519 | A | 10/1994 | Grabscheid et al. |

FOREIGN PATENT DOCUMENTS

| | | | |
|---|---|---|---|
| GB | 1202167 | | 8/1970 |
| WO | 02/22950 | A1 | 3/2002 |
| WO | 2006/010794 | A1 | 2/2006 |

OTHER PUBLICATIONS

International Search Report issued in PCT/FI2005/050232.

*Primary Examiner*—Mark Halpern
(74) *Attorney, Agent, or Firm*—Stiennon & Stiennon

(57) ABSTRACT

A beam structure for a web forming machine is arranged to be supported by its end components (10) on the web forming machine. The beam structure includes a casing structure (15) of a thin-sheet material, inside which a stiffener structure (30) is arranged. In addition, the casing structure (15) and the stiffener structure (30) are secured to each other to create a load-bearing beam structure.

18 Claims, 8 Drawing Sheets

BEAM STRUCTURE FOR A WEB FORMING MACHINE

CROSS REFERENCES TO RELATED APPLICATIONS

This application is a U.S. national stage application of International App. No. PCT/FI2005/050232, filed Jun. 22, 2005, the disclosure of which is incorporated by reference herein, and claims priority on Finnish App. No. 20045281, filed Jul. 28, 2004, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to a beam structure for a web forming machine, which beam structure is arranged to be supported by its end components on the web forming machine.

Beam structures, which are generally supported on the web forming machine only by their end components, are used in different positions in a web forming machine, for example, in a paper or board machine. Usually the beam structure extends across the web forming machine for its entire width and is used to carry some device used in the process. Such devices are, for example, doctors, measuring devices, and coaters.

In the web forming process, temperatures are relatively high. In addition, the thermal load acting on the beam structure is often one-sided, which causes detrimental deflection in the beam structures due to the uneven thermal expansion. The deflection causes disturbances and errors in the operation of the device that is carried by the beam structure. For example, a doctor blade wears unevenly and the reading of a measuring device is erroneous. In known beam structures, a beam-like oscillation specific to them also appears, which is induced by the rotation of other devices, or generally by vibration arises from operation. The vibration further increases the disturbances caused by deflection. Particularly beam structures with a length of more than eight meters and which are used in connection with a web travelling at more than 1500 meters per minute, are large, expensive, and prone to vibration-related problems. In addition, in a web forming machine there are rolls, the rotational frequency, or semi-critical vibration of which will also induce vibration in a beam structure. This causes, for example, detrimental variations in the amount of coating in a coater.

In order to avoid deflection arising from thermal expansion, in known beam structures insulation is fitted around the load-bearing core structure. The insulation is intended to prevent heat being conducted to the core structure, so the temperature of the core structure will remain as even as possible. In order to protect the insulation, a casing structure is arranged, which also holds the insulation in place. However, the insulation with its casing structure also increases the total weight of the beam structure and thus also the deflection in the beam structure. This is because the insulation and the core structure are not load-bearing. Further, the insulation and its casing structure have no effect whatever on the vibration of the beam structure. At its worst, the casing structure itself can vibrate, which can induce vibration in the core structure.

SUMMARY OF THE INVENTION

The invention is intended to create a new type of beam structure for a web forming machine, by means of which the drawbacks caused by thermal loading and vibration, as well as other problems in the prior art, can be avoided. In the beam structure according to the invention, a new type of combination structure is applied, by means of which a light, but stiff structure is created. In addition, the insulation is implemented in a new and surprising manner. Firstly, essentially all the components are part of the load-bearing structure, so that the stiffnesses of the various components can be exploited to stiffen the entire structure. Secondly, the insulation can also be arranged to be a damping element, so that the specific frequency of the beam structure becomes more advantageous than previously. The functional combination of the core structure, the insulation, and the casing structure also permits the use of thinner materials than previously. This facilitates the manufacture of the beam structure and further reduces the total mass of the beam structure. In addition, by using conventional materials, properties are created in the beam structure that earlier could be partly achieved using expensive composite materials. In the beam structure according to the invention it is possible to use composite components, but their structure is simple, which keeps costs to a reasonable level. Functions that are impossible in the prior art can also be added to the beam structure according to the invention. Overall, the stiffness of the beam structure relative to its weight is excellent while the beam structure becomes well protected from dirt and otherwise durable. The beam structure equipped with additional functions is suitable for use in even the most demanding positions in a web forming machine.

In the following, the invention is examined in detail with reference to the accompanying drawings, showing some embodiments of the invention.

DESCRIPTION OF THE PREFERRED EMBODIMENTS

Figure 1:
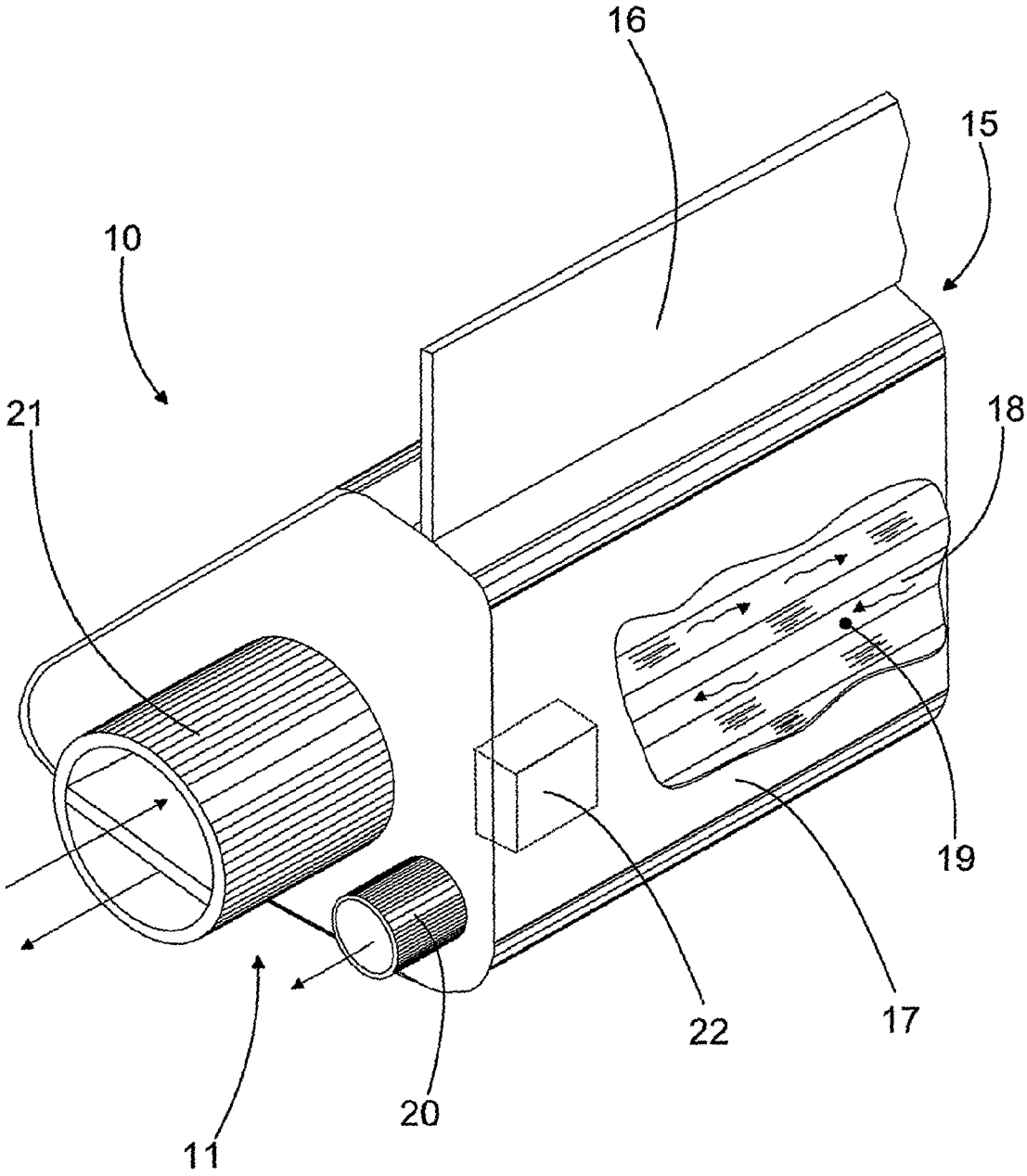
FIG. 1 shows an axonometric view of the beam structure according to the invention.

FIG. 1 shows only part of the beam structure according to the invention. The beam structure is intended particularly for a web forming machine. In a web forming machine, for example in a paper machine, the beam structure is supported from its end parts on the frame. In other words, the beam structure extends from one side of the web forming machine to the other. Modern beam structures can even be more than ten meters long, so that the deflection of, and vibration in the supported beam structure are important design considerations. The beam structure of FIG. 1 is intended as a doctor beam, to which the doctor blade is attached with the aid of a blade holder. The doctor beam is supported rotatably on the frame by bearings, so that by rotating the doctor beam the doctor blade can be loaded against the surface to be doctored. In each end part 10 of the doctor beam, there is a suitable protruding shaft 11 or corresponding lug for the attachment of the bearing.

Figure 2:
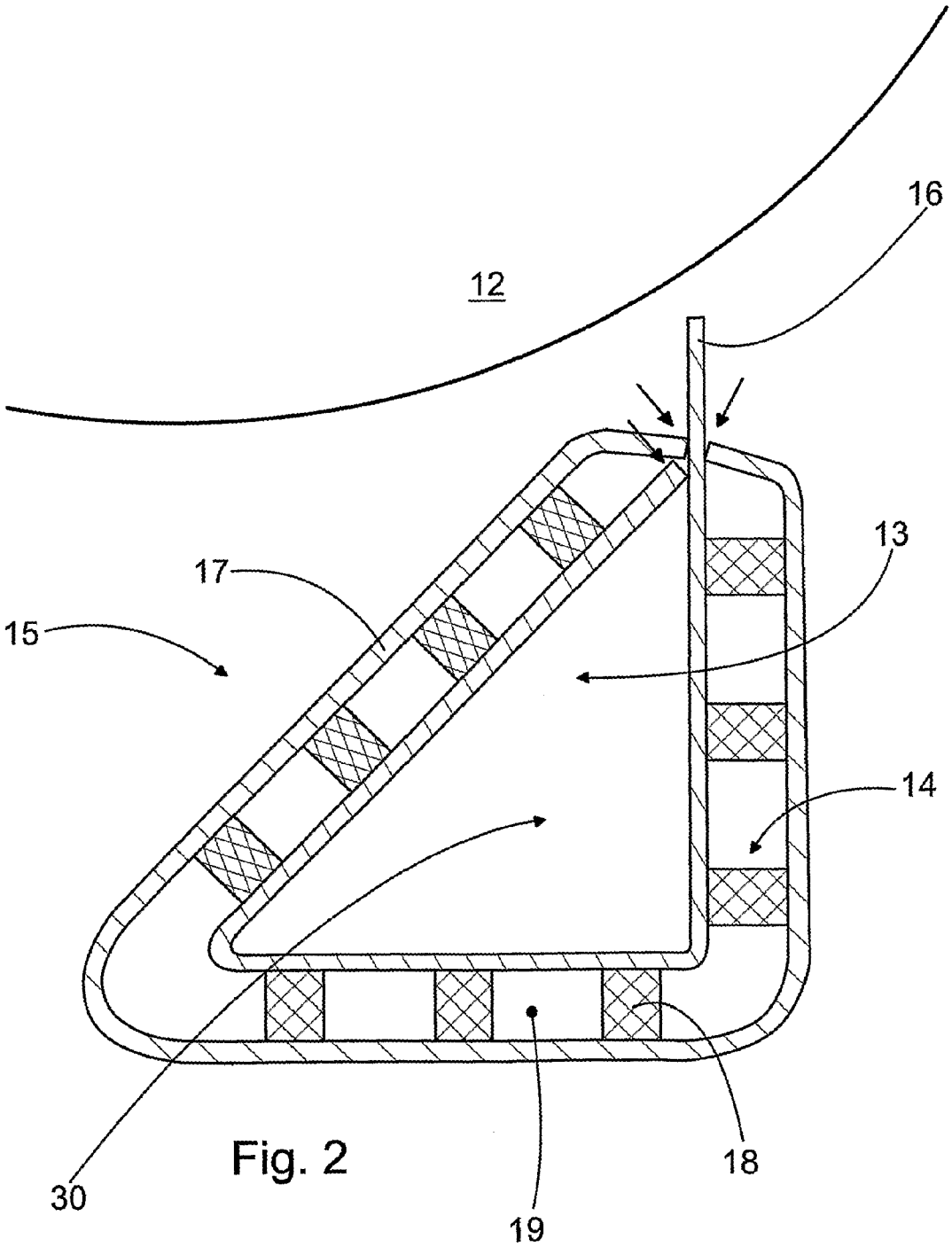
FIG. 2 shows a schematic cross-section of the beam structure according to the invention.

Beam structures according to the invention are characterized by a thin-sheet construction casing structure 15, with a stiffener structure 30 fitted inside it. In addition, the casing structure 15 and the stiffener structure 30 are secured to each other to create a load-bearing beam structure. Thus, even a thin material can be used to create a light but stiff beam structure. In addition to the casing structure 15, the stiffener structure 30 also preferably is at least partly of a thin-sheet material. In practice, the thickness of the thin-sheet material is 1-5 mm, preferably 2-4 mm. Metal sheets of this kind are easily shaped, machined, and joined. In addition, instead of a triangular cross-section, the beam structure can surprisingly be made essentially round. In the following, various embodiments are examined in greater detail. FIG. 2 shows a schematic cross-section of the beam structure according to the invention. Particularly a doctor beam is placed close to the surface to be doctored, which, for example, in the case of a dryer cylinder 12, is also extremely hot. In that case there will be a significant thermal load acting on the doctor beam from one side. The protected beam structure includes a load-bearing core structure 13 and insulation 14 fitted around it. The insulation is used to prevent heat transferring to the core structure and thus to avoid the deflection and other deformations caused by thermal expansion. In addition, a casing structure 15 is fitted around the insulation 14, which protects the insulation 14 and holds it in place. In the prior art, the use of insulation and a casing structure only achieves the functions referred to above. According to the invention, the core structure, the insulation and the casing structure are instead secured to each other mechanically, to create a load-bearing beam structure. In other words, all the basic elements participate in carrying the load and thus together form the load-bearing beam structure. Thus a good stiffness/weight ratio and low total weight are created in the beam structure, which significantly reduces deflection.

In principle, any material whatever, which creates an insulating effect and which can be reliably attached both to the core structure and to the casing structure, can be used as the insulation. According to the invention, the insulation is preferably a material, with a modulus of elasticity of less than 10 $N/mm^2$. In practice, this means a relatively flexible material, so that at the same time a damping beam structure will be achieved. In other words, besides the insulating effect the insulation can also be used to advantageously affect the specific frequency of the beam structure, and through it its vibration properties. The structure and material of the insulation will be examined in greater detail later, in connection with FIGS. 2 and 3.

In the prior art, the beam structure is made from a thick material, which is laborious to machine while several different parts must be joined to each other. The core structure and the casing structure according to the invention are of a sheet material, the sheet thickness of the casing structure being the same or less than in the core structure. Thus, in the manufacture of the core structure and the casing structure it is possible to use the same devices and methods. In addition, the thermal expansion will be even in the various parts of the beam structure, which will reduce the internal stresses in the beam structure. The sheet material is less than 15 mm thick, preferably less than 10 mm thick. Thin-sheet technology is preferably used in the manufacture, in which case the thickness of the sheet material used will be less than 5 mm. Due to the demanding conditions, stainless steel is preferably used in manufacture.

FIG. 2 shows the beam structure according to the invention in greater detail. In this cross-sectional plane, the beam structure includes on two sheet parts 16 and 17, which can be shaped diversely. In the embodiment of FIG. 2, the core structure is first bent into the shape of a right-angled triangle using suitable sheet-working machines, from the first sheet part 16. After this, the triangular core structure is closed. In the sheet working and the welding it is preferable to use a laser, in which case a beam structure with an accurate shape and dimensions will be created. If necessary, it is also possible to use other machining and joining methods. In the longitudinal direction of the beam structure, several sheet parts are used, between which are butt-joints. The closed and simple structure will remain clean and can be easily cleaned.

In the embodiment of FIG. 2, the casing structure is manufactured from a second sheet part 17, in which curved bends are made, in order to avoid sharp protrusions. Like the core structure, the casing structure is closed, and preferably it is also attached to the core structure. FIG. 2 uses small arrows to show the location and direction of the laser welds in the sheet pieces 16 and 17. Before the casing structure is installed and attached, the core structure is installed. In this case, the core structure is, in addition, an insulation, which is formed of an elastic mass that is fitted between the core structure and the casing structure. More specifically, in the embodiments of FIGS. 1 and 2 the insulation is formed of several elastic insulation pieces 18, which are arranged at a distance from each other, to create the cell structure. The cell structure becomes light and free spaces permit the dynamic movement of the insulation pieces, which in practice effectively damps vibration. Various rubbers or elastomers, for example, can be used as a damping insulation.

The beam structure described above is light, but stiff, and has in it insulation that damps vibration. In the operation conditions of a web forming machine, the beam structure may heat strongly, or the one-sided thermal load may bend the beam structure. Connections 19 for circulating a medium in the beam structure, to adjust its temperature as desired are fitted in connection 14 with the insulation according to the invention. In a web forming machine, mainly cooling will be required, but in some positions even heating may be required, in order to maintain the desired temperature. On the other hand, simply circulating the medium in the beam structure will create the same temperature in its various parts. If necessary, the connection can be located, for instance, inside the core structure, but the effect of a medium between the core structure and the casing structure will be well spread throughout the entire beam structure.

According to the invention, an individual insulation piece is arranged in the beam structure longitudinally and/or transversely. In that case, the connection will be formed for the space delimited by two insulation pieces and the core structure and the casing structure. The insulation pieces too are attached to the core and casing structures, for example, by gluing or vulcanization. In FIGS. 1 and 2 the insulation pieces 18 are longitudinal. Complex connections can be made from the insulation, by cutting the insulating material suitably. In addition, a long piece of insulation can run in a spiral, which will easily create a long connection. In FIG. 2 the circulation of the medium in the connections 19 is shown schematically. In addition to the closed circulation of the medium, it is also possible to lead a medium from outside, for example, through a connector pipe 20, or even a pipe formed through the protruding shaft 11. In that case, pumping means intended to circulate the medium are fitted in the vicinity of the beam structure, when they will also include heat-exchanging means. In a closed circulation, purely pumping means 22 arranged in connection with the beam structure will be sufficient, these being preferably fitted inside the casing structure (FIG. 1). The pumping means and connections will then be well protected without dirt-collecting protrusions.

Figure 3:
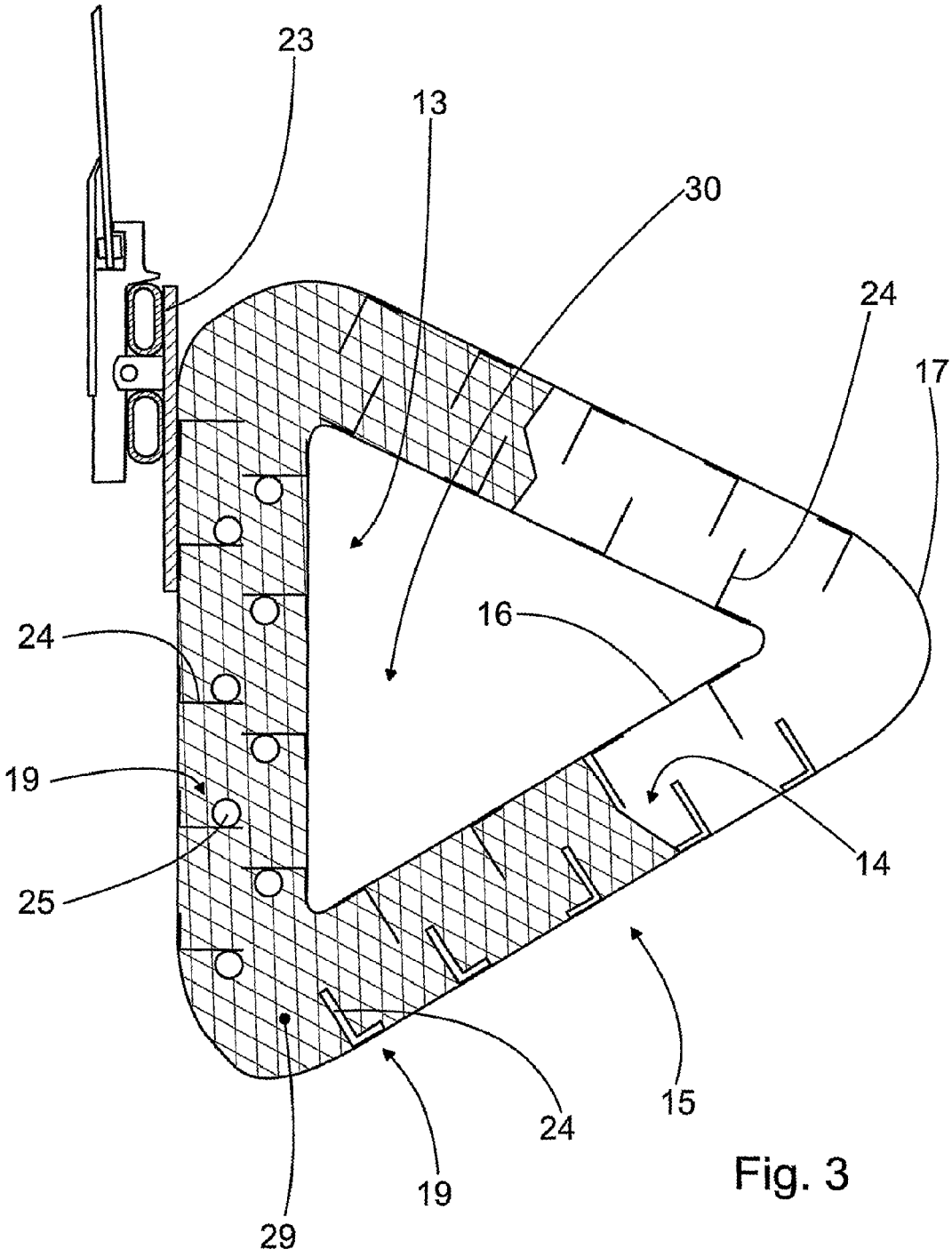
FIG. 3 shows a second embodiment of the beam structure according to the invention.

FIG. 3 shows a second embodiment of the beam structure, which in this case is arranged as a doctor beam. For attaching the blade holder, there is an installation plate 23 in the beam structure, to which various devices, such as a blade holder, can be attached. The beam structure in question can be made in a way differing from the previous description. The core and casing structures 13 and 15 can be made completely finished and the insulation 14 installed between them. Preferably foam 29, however, is used as the insulation, and is extruded between the core and casing structures 13 and 15. In FIG. 3, only part of the foam 29 is shown. For complete filling, an insulation that is lighter than rubber can be used, which will however achieve good insulation and damping properties. The joint between the insulation and the cores and casing structures 13 and 15 can be improved by using intermediate flanges 24, to which the insulation 14 is mechanically attached. Thus the movements and deflections of the structures are converted into a shear force, which is attenuated effectively in the flexible insulation. Preferably the intermediate flanges are attached to both the outer surface of the core structure and the inner surface of the casing structure. The structures will then be firmly joined to each other. In some structures it may be sufficient, if the intermediate flanges and arranged on either the outer surface of the core structure, or the inner surface of the casing structure. In FIG. 3, the intermediate flanges 24 are on both. Particularly when using foam as an insulator, the insulation is also attached to the intermediate flanges. If necessary, holes or protrusions, for example, are arranged in the intermediate flanges, to ensure adhesion (not shown).

The intermediate flanges are intended to attach the insulation to the adjacent structure. In terms of the operation of the insulation, the intermediate flanges intentionally extend only to some distance from the opposite surface. By attaching each intermediate flange to both the core structure and the casing structure, the damping effect of the insulation would be lost, which would often be disadvantageous.

Also in the embodiment of FIG. 3 there are connections 19 for circulating a medium in the beam structure. In addition, in this embodiment example there are in fact three kinds of intermediate flanges. At the upper side of the triangular beam structure there are L-shaped flanges 24, which are attached by their shorter sides, for example, by welding. The intermediate flanges extend for the entire length of the beam structure and are formed of one or more parts. Correspondingly, the connections 19 at the lower side of the beam structure are formed from intermediate flanges 24. Thus the intermediate flange in question has two functional tasks. In addition to being a mechanical joint element, it also acts as a connection. Correspondingly, the conventional pipes 25 arranged in connection with the intermediate flanges can be used as connections 19, as has been done on the vertical side of the beam structure. Despite the construction and number of the connections and intermediate flanges, the weight/stiffness ratio of the beam structure according to the invention is clearly better than that of the known structure. Particularly by using an installation plate the beam structure can be made from thin sheet, which will further facilitate manufacture and reduce the total weight.

The above is a description of the beam structure when acting as a doctor beam. There are several doctors in a web forming machine and these are, in addition, loaded, which is problematic in terms of vibration. Thus the doctor beam structure according to the invention is arranged in such a way that its specific frequency is different to the induced frequency in the surface being doctored. This avoids particularly the vibrations induced in each other by parts that are joined together. The damping properties can be tailored to be suitable for each position, through the insulating material and its amount and shape. Otherwise, the beam structure is dimensioned as a function of the width of the web forming machine and the loading of the beam structure.

Figure 4:
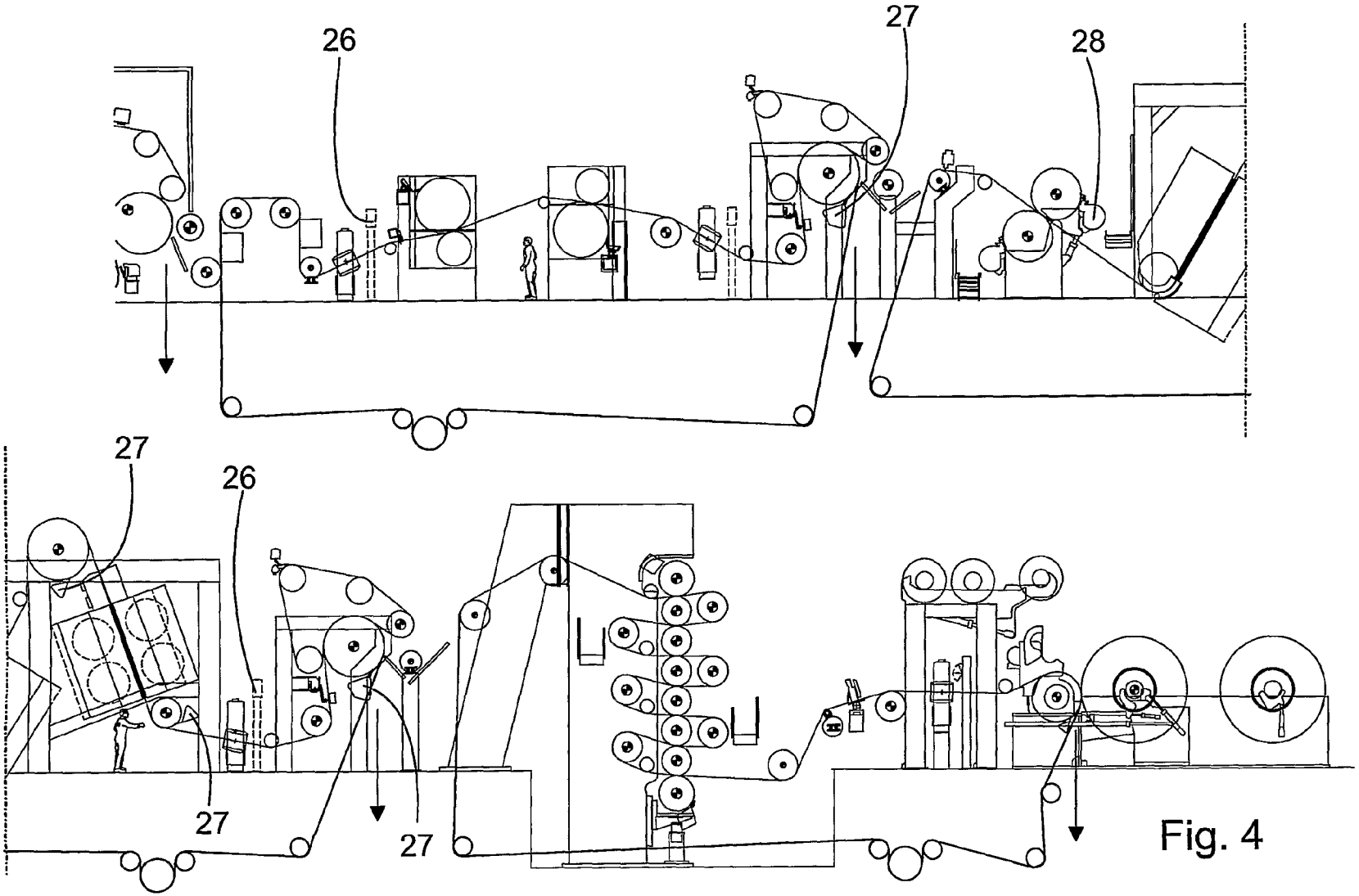
FIG. 4 shows various applications of the beam structure according to the invention in a web forming machine.

FIG. 4 shows a few applications of the beam structure according to the invention in the finishing section of a paper machine. The beam structure can also be applied elsewhere in a paper machine. In this case, the beam structure is first in the measuring beam 26 belonging to the web forming machine. In addition, the beam structure can be used, for example, as a doctor beam 27, or a coating beam 28.

Figure 5A:
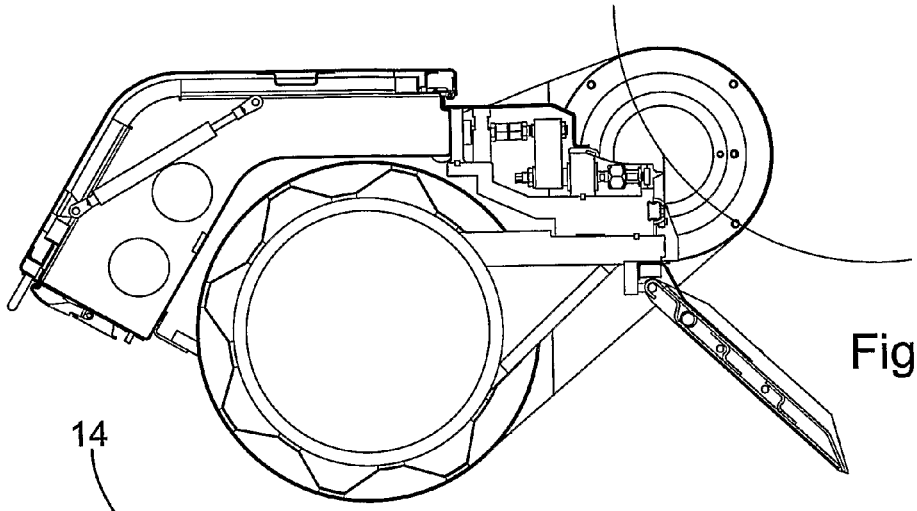
FIG. 5*a* shows a coater beam equipped with the third embodiment of the beam structure according to the invention.
Figure 5B:
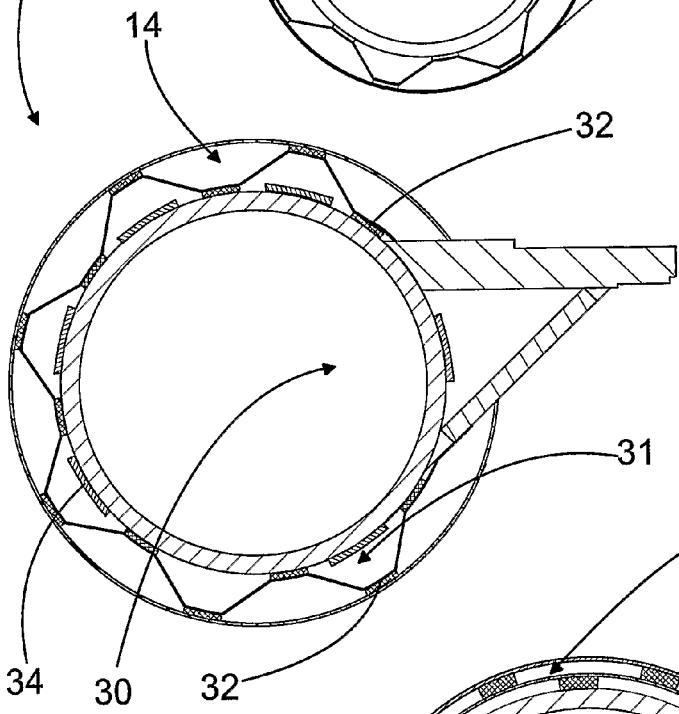
FIG. 5*b* shows a cross-section of the beam structure of FIG. 5*a*.

FIG. 5*a* shows a coating beam, which is based on the beam structure according to the invention. The cross-section of the beam structure in question is shown in FIG. 5*b*. In this case, the insulation is formed of an intermediate structure 31 fitted between the core structure 13 and the casing structure 15. In addition, the intermediate structure 31 is arranged to be attached by an elastic mass to both the inner surface of the core structure 13 and the outer surface of the casing structure 15. The intermediate structure is also preferably of thin-sheet material. In addition, the shape of the intermediate structure corresponds to the shape of the core structure, or else it is corrugated, as in FIG. 5*b*. In addition, the elastic mass is arranged in several longitudinal parts 32 of the beam structure, which are arranged at a distance from each other, to create a cell structure. The cell structure thus formed significantly increases the structural damping and reduces vibration and the amplitude of the movement that causes in the beam structure, to a lower level than previously. Then the vibration problems vanish. At the same time, the diameters of the rolls used in the vicinity of the beam structure, for example, wire and paper guide roll, can be selected more freely than previously. The cell structure can also be used to circulate a medium in the beam structure.

Figure 5C:
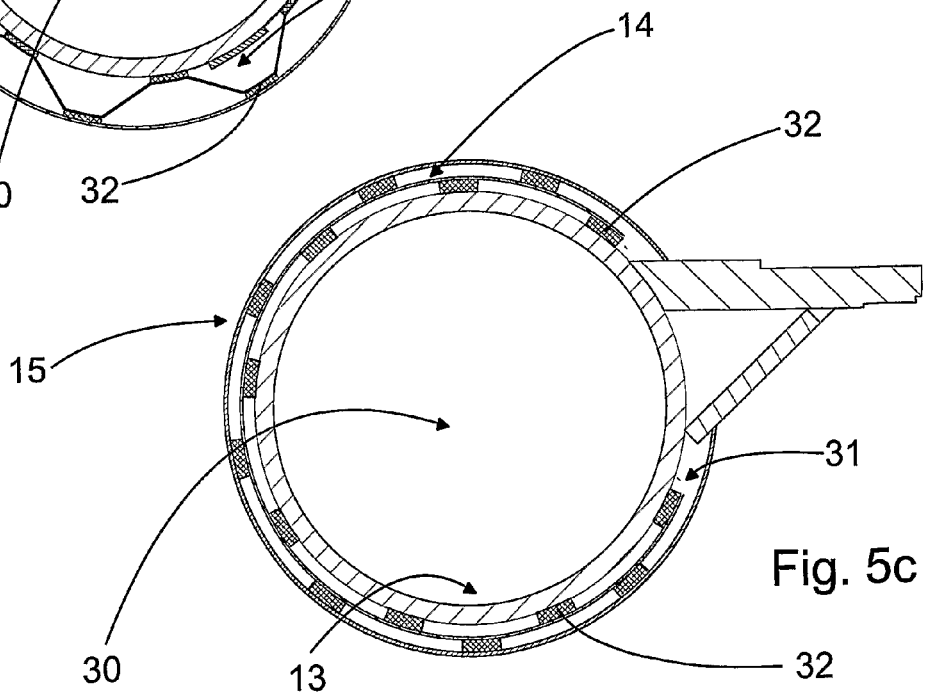
FIG. 5*c* shows an adaptation of the beam structure of FIG. 5*a*.

In the manufacture of the beam structure of FIGS. 5*b* and 5*c* a ready-made pipe is used as the core structure, on top of which a shaped thin sheet is bent. In this case, the wall thickness of the ready-made pipe is clearly greater than thin sheet, though it too can be made to be considerably thinner than known solutions. In the beam structure, the outermost part is the casing structure of thin sheet and all the parts are joined to each other either by welding or gluing. Vulcanization can also be used to attach rubber. The aforementioned elastic parts are used between the structures. In the embodiment of FIG. 5*c*, a thin sheet that corresponds to the shape of the core structure is used as the intermediate structure. In addition, there are more parts 32 than in the previous embodiment and they are thicker, which increases the damping of the intermediate structure. The cellular structured beam structure is cheaper and lighter than previously and its dynamic properties are much better than in existing solutions. A beam structure of this kind can be exploited in new machine lines, or when increasing the speed of an old web forming machine.

Figure 6:
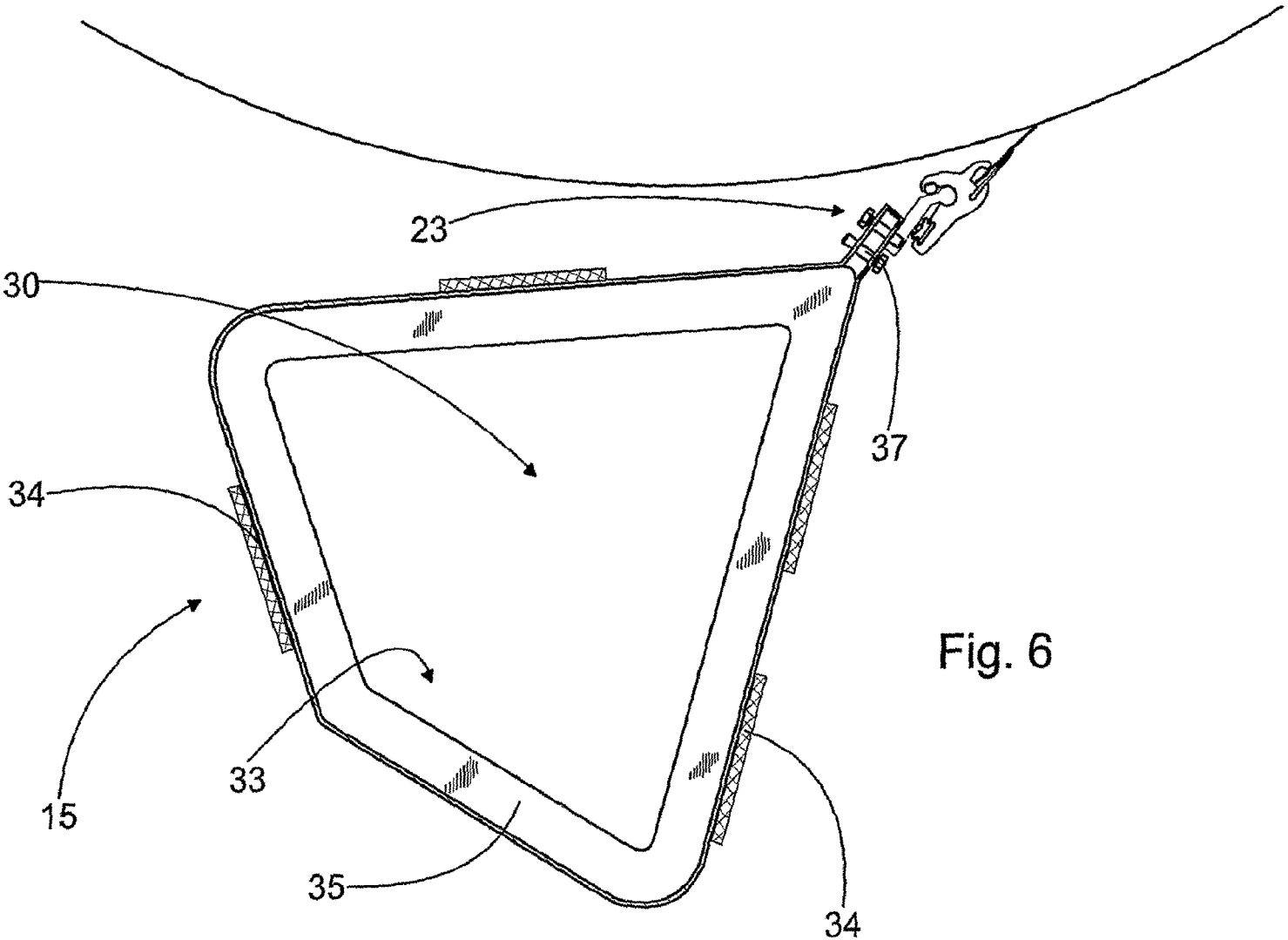
FIG. 6 shows a doctor arrangement equipped with a fourth embodiment of the beam structure according to the invention.
Figure 7:
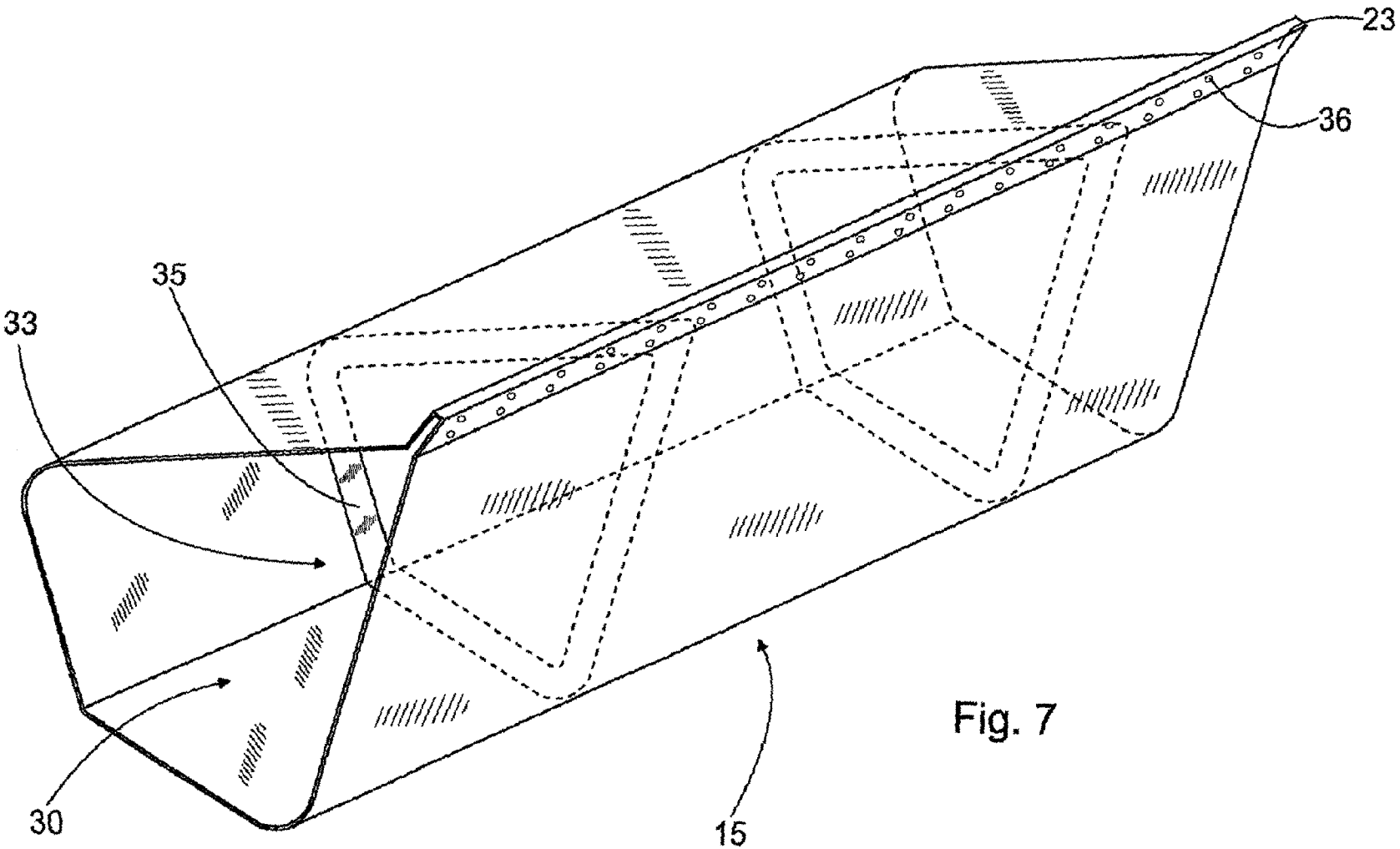
FIG. 7 shows an axonometric view of the beam structure of FIG. 6.

FIG. 7 shows the beam structure at it simplest, particularly when arranged as a doctor beam. In this case, the beam structure includes a casing structure 15 of thin-sheet material, inside which a stiffener structure 30 is fitted. In other words, a core structure and insulation are lacking. Despite this, the beam structure is stiff, as the material is located on the circumference of the beam structure. Despite its stiffness, the beam structure shown is extremely light, weighing only five kilograms for each meter of length. In practice, the stiffener structure 30 includes stiffeners 33 running in the longitudinal direction of the beam structure, which are secured to the casing structure 15, to create a load-bearing beam structure. Thus a cell structure is created, with excellent bending and torsional stiffness. In addition, the deflection of the beam structure due to its own weight is small. The stiffeners can be of solid plates or compartments. However, at least some of the stiffeners 33 are preferably rib structures 35. In that case, even a small amount of material will create a significant stiffening effect. As in the other beam structures according to the invention, the rib structure too is made from thin-sheet material, with a thickness of 2-5 mm. In practice, the use of laser cutting will create dimensionally precise stiffeners, around which the casing structure is bent and laser-welded shut. The final result is a finished unmachined beam structure, which is stiff, but light. According to the invention, the massive installation plate 23 using in the prior art is also a thin-sheet structure, in which machining is unnecessary. Holes 36 for the installation and adjustment screws 37, shown in FIG. 6, can also be easily cut by laser in the installation plate.

Figure 8A:
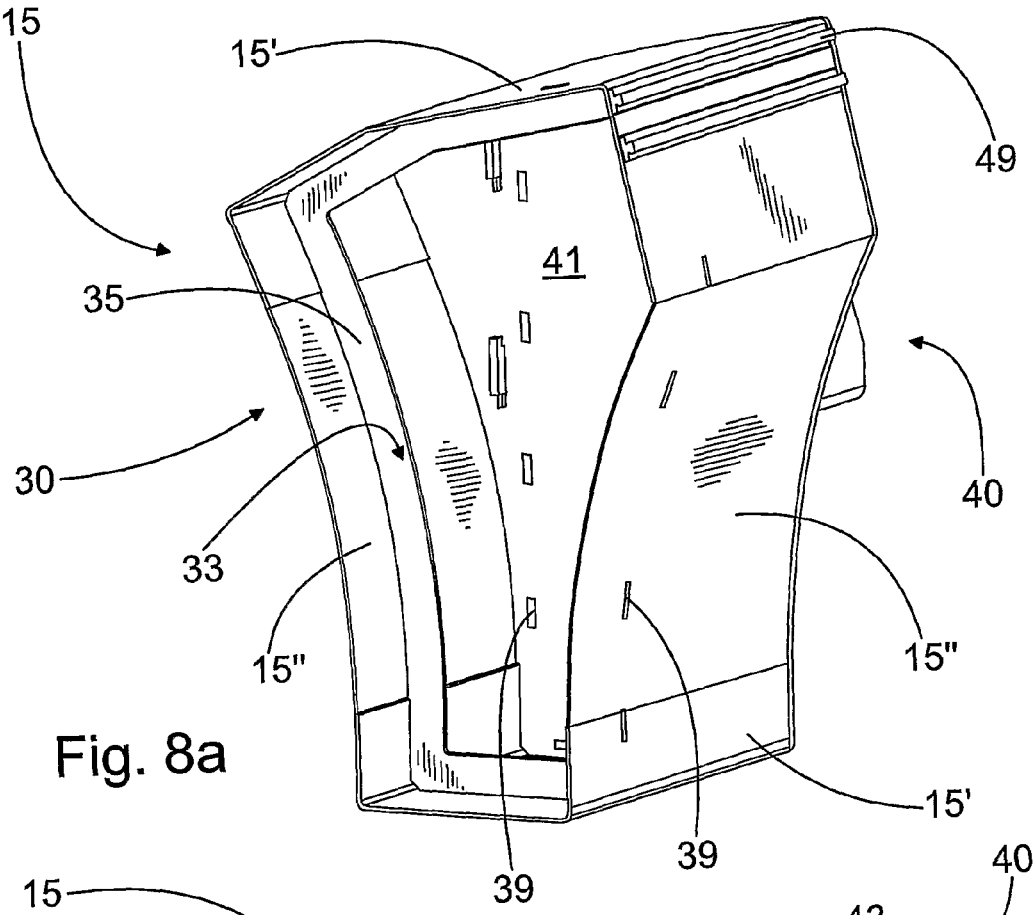
FIG. 8*a* shows a cross-section of a fifth embodiment of the beam structure according to the invention.
Figure 8B:
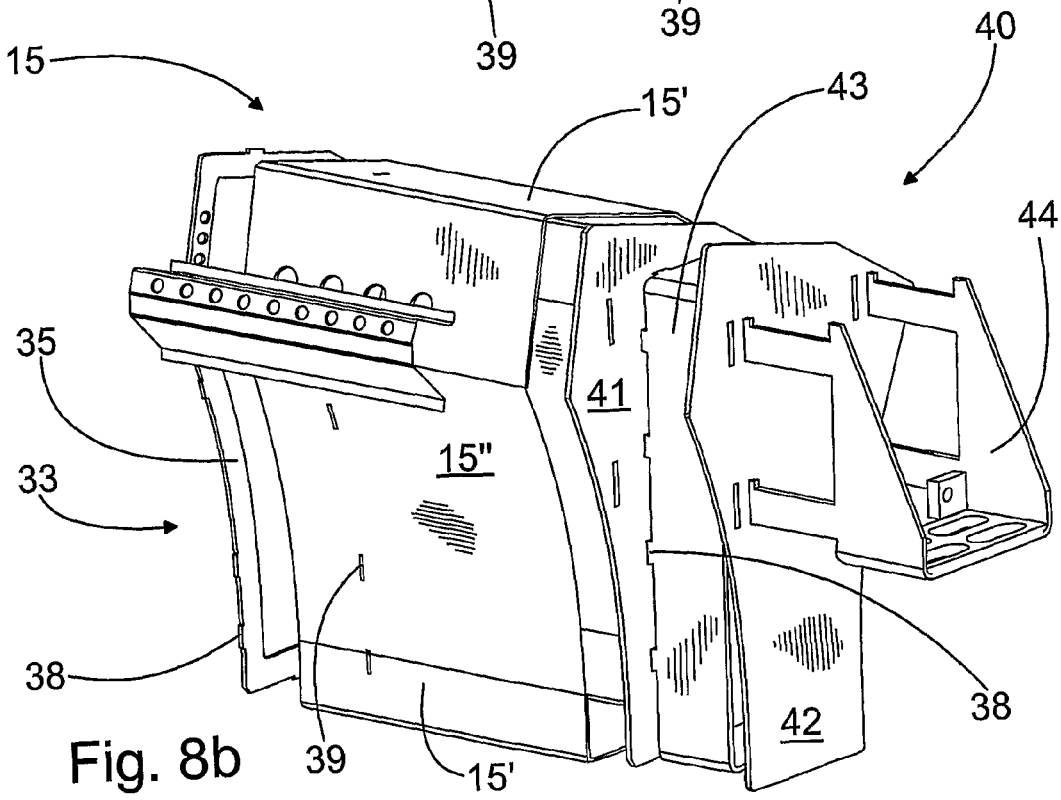
FIG. 8*b* shows the components of the beam structure of FIG. 8*a* partially installed.

FIGS. 8*a* and 8*b* show a fifth embodiment of the beam structure according to the invention. Generally, the casing structure 15 can be manufactured from one or more plate pieces 15' and 15". In FIG. 8*a*, four plate pieces 15' and 15" are used. The plate pieces are of thin-sheet material and their thicknesses can also differ, for example, some being 4-mm thick and the rest only 0.5-mm thick. In the embodiment shown the lower and upper plate pieces 15' are thicker than the other two curved plate pieces 15".

In the rib structures 35 of FIGS. 8*a* and 8*b* there are also lugs 38, the openings 39 corresponding to which are machined in the plate pieces 15' and 15". The lugs facilitate manufacture and increase the durability of the beam structure. Both the lugs and the openings can be easily made using laser cutting, when the parts will be ready for installation without machining.

In the beam structure according to the invention, there is also a special end piece 40, which also stiffens the end of the beam structure. By means of the end piece, the beam structure is also attached to the frame of the web forming machine. The end piece that acts as a stiffener is preferably of a box or cell structure. In FIG. 8*b*, an intermediate box 43 is arranged, in the axial direction of the beam structure, between two plates 41 and 42 shaped like the casing structure 15. In the intermediate box 43 bent from thin sheet there are also lugs 38, openings 39 corresponding to which being arranged in the plates 41 and 42. Finally, a connecting piece 44 shaped from thin sheet, which secures the end piece to form a box and from which the beam structure is supported, is finally fed through the plates 41 and 42. All the parts referred to above are of thin-sheet material. The length of the intermediate box, i.e. the distance between the plates, is about 50-400 mm. In place of the intermediate box between the plates there could be, for example, a honeycomb structure or similar.

The embodiments of FIGS. 8*a* and 8*b* lack the conventional installation plate. However, it would be particularly advantageous for the installation plate to be of the same piece as the casing structure, or some part of it. This would eliminate a separate work stage to attach the installation plate to the beam structure. The installation plate is also referred to as a nose plate. In FIG. 8*a* attachment rails 49 for the doctor are glued to the casing structure. Various connections can be arranged inside the hollow beam structure and the beam structure can even be used to created air blasts, by pressurizing the beam structure (FIG. 8*b*).

The size, shape, and number of stiffeners vary according to the size and design load of the beam structure. Generally, there are 0.5-5, preferably 0.5-2 rib structures 35 for each meter of length of the beam structure. FIG. 7 shows two rib structures 35, which are attached inside the casing structure 15. In this embodiment too connections can also be used inside the beam structure. Deflection due to the thermal load can also be avoided in another way. According to the invention, carbon-fiber stiffeners 34, shown in FIGS. 5B and 6, running in the longitudinal direction of the beam structure, can be arranged on the outer and/or inner surface of the casing structure and/or the stiffener structure. The longitudinal direction of the beam structure corresponds to the cross direction of the web forming machine. The carbon-fiber stiffeners 34 are arranged in such a way that the total thermal expansion coefficient of the beam structure is essentially zero. In practice, beam structures made from steel will bend, if some part of the beam structure is at a different temperature. According to the invention, the beam structure is reinforced at the correct points by carbon-fiber stiffeners, which can be simply flat or profiled. The arrangement permits a negative thermal expansion coefficient in the carbon fiber. When installing the carbon-fiber stiffeners, allowance must be made for that the joints bear the thermal stresses arising. In other words, there should be adequate mechanical attachment in the joints, in addition to the glued joint. For example, in a cellular-structured beam structure, the carbon-fiber stiffeners can be placed inside the cells (FIG. 5*b*), or even on the outer surface of the casing structure (FIG. 6). In addition, the locations and surface-area ratios of the carbon-fiber stiffeners and the steel should be selected in such a way that deflection is avoided in the beam structure and the steel plates used will withstand a compression load without buckling.

The beam structure according to the invention is extremely diverse and can be used in different places in a web forming machine. By combining the various parts to form an integrated structure, an advantageous weight-to-stiffness ration will be achieved. In addition, durable materials can be used in the manufacture while the construction remains simple. In addition to thermal adjustability, the beam structure according to the invention creates effective damping, by means of which vibration problems can be avoided, or at least reduced. Deflection due to a thermal load can also be avoided.

The invention claimed is:

1. A beam structure in a web forming machine comprising:

a casing structure, constructed of sheet metal material 1-5 mm thick, which extends in the cross machine direction across the web in the web forming machine;

a plurality of intermediate stiffeners positioned on the interior of the casing, and spaced from one another in the cross direction, said intermediate stiffeners formed of sheet material having a thickness of 2-5 mm, wherein the thickness is arranged to extend in the cross direction.

2. The beam structure of claim 1, wherein at least one of the plurality of intermediate stiffeners is formed as a plate which extends over a cross-section defined by the beam.

3. The beam structure of claim 1, wherein at least one of the plurality of intermediate stiffeners is formed as a rib structure which extends over part of a cross-section defined by the beam and which rib structure defines a hole so that the rib structure does not cover the entire cross-section defined by the beam.

4. The beam structure of claim 1, wherein two of the plurality of the intermediate stiffeners are formed as a box structure which form cross direction ends of the beam structure.

5. The beam structure of claim 1, wherein there are 0.5 to 5 stiffeners for each meter of length of the beam structure.

6. The beam structure of claim 1, wherein at least one of the plurality of intermediate stiffeners is formed of carbon-fiber.

7. The beam structure of claim 1, further comprising a plurality of carbon-fiber stiffeners extending in the cross direction of the beam structure and attached to the casing structure such that the beam structure has a total thermal expansion coefficient which is essentially zero over a selected temperature range.

8. The beam structure of claim 1, wherein the beam structure is one of a measuring beam, a doctor beam, or a coating beam.

9. The beam structure of claim 1, wherein at least one of the plurality of intermediate stiffeners is formed as a rib structure which extends over part of a cross-section defined by the beam and which rib structure defines a hole so that the rib structure does not cover the entire cross-section defined by the beam.

10. The beam structure of claim 1, wherein at least one of the plurality of intermediate stiffeners is formed of carbon-fiber.

11. The beam structure of claim 1, wherein the casing structure and the plurality of intermediate stiffeners are formed of steel.

12. The beam structure of claim 1, wherein the casing structure and the plurality of intermediate stiffeners are joined by welds.

13. The beam structure of claim 1 further comprising an installation plate to which various devices can be attached, wherein the installation plate is of the same piece with the casing structure.

14. The beam structure of claim 1, wherein the plurality of intermediate stiffeners are formed with lugs which extend outwardly of the intermediate stiffeners and engage corresponding openings in the casing structure so that thelugs facilitate manufacture and increase the durability of the beam structure.

15. The beam structure of claim 1, wherein attachment rails for a doctor are glued to the casing structure.

16. The beam structure of claim 1 wherein each of the beam end structures further comprises:

an intermediate box arranged in an axial direction of the beam structure between the two intermediate stiffeners, wherein the intermediate box is formed of bent thin sheet metal having lugs which engage corresponding openings in the two intermediate stiffeners; and a connecting piece shaped from sheet metal in connecting engagement with the two intermediate stiffeners to form a box with the two intermediate stiffeners and the intermediate box, wherein the connecting piece forms a beam support structure.

17. A measuring beam, a doctor beam, or a coating beam structure in a web forming machine comprising:

a casing structure, constructed of sheet-metal material 1-5 mm thick, which extends in a cross direction across the web in the web forming machine;

plurality of intermediate stiffeners, each intermediate stiffener being formed as a plate which extends over a cross-section defined by the beam and positioned on the interior of the casing, the intermediate stiffeners being spaced from one another in the cross direction 0.2 to 2 meters apart along the beam structure, said intermediate stiffeners formed of sheet material having a thickness of 2-5 mm, wherein the thickness is arranged to extend in the cross direction, and the intermediate stiffeners are attached to the casing structure;

a plurality of carbon-fiber stiffeners extending in the cross direction of the beam structure and attached to the casing structure such that the beam structure has a total thermal expansion coefficient which is about zero over a selected temperature range; and wherein the beam has cross direction end structures formed of two of the plurality of the intermediate stiffeners formed as a box or cell structure.

18. A method of forming a beam structure in a web forming machine comprising the steps of:

laser cutting a plurality of intermediate stiffeners from sheet metal material having a thickness of 2-5 mm;

forming a casing structure by bending a sheet-metal material of 1-5 mm thickness about the plurality of intermediate stiffeners, so the stiffeners are arranged to form plates which extend over a cross-section defined by the beam, so that the plurality of intermediate stiffeners are positioned on the interior of the casing, and spaced from one another in a cross-machine direction 0.2 to 2 meters apart along the beam structure;

laser welding shut the casing structure;

attaching a plurality of carbon-fiber stiffeners to the casing structure so the carbon-fiber stiffeners extend in the cross machine direction of the beam structure and such that the beam structure has a total thermal expansion coefficient which is essentially zero over a selected temperature range; and wherein two of the plurality of the intermediate stiffeners are formed as a box structure and used to form cross machine direction ends of the beam structure.

* * * * *

UNITED STATES PATENT AND TRADEMARK OFFICE

CERTIFICATE OF CORRECTION

PATENT NO. : 7,662,261 B2
APPLICATION NO. : 11/572250
DATED : February 16, 2010
INVENTOR(S) : Kurkinen et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 463 days.

Signed and Sealed this

Thirtieth Day of November, 2010

David J. Kappos

David J. Kappos
*Director of the United States Patent and Trademark Office*